United States Patent [19]

Sharp

[11] 4,051,622

[45] Oct. 4, 1977

[54] FREE FLYING AERODYNAMIC TOY WITH HIGH STABILITY

[76] Inventor: Peter A. Sharp, 520 Utah St., San Francisco, Calif. 94110

[21] Appl. No.: 676,042

[22] Filed: Apr. 12, 1976

[51] Int. Cl.[2] ..... A63H 27/00

[52] U.S. Cl. ..... 46/74 R; 46/60; 244/21; 244/153 A

[58] Field of Search ..... 244/10, 21, 39, 153 A, 244/153 R; 46/74 R, 75, 82, 85, 84, 60–63, 83; 416/4; 273/95 R, 106 R

[56] References Cited

U.S. PATENT DOCUMENTS

| | | | |
|---|---|---|---|
| 901,037 | 10/1908 | Philippart | 46/60 |
| 1,698,819 | 1/1929 | Massey | 244/21 |
| 2,501,442 | 3/1950 | Donaldson | 244/153 A |
| 2,713,392 | 7/1955 | Von Karman et al. | 416/4 |
| 3,262,656 | 7/1966 | Boehler et al. | 244/39 |

FOREIGN PATENT DOCUMENTS

| | | | |
|---|---|---|---|
| 2,252,230 | 3/1974 | Germany | 244/153 A |
| 483,043 | 4/1938 | United Kingdom | 244/10 |
| 640,522 | 7/1950 | United Kingdom | 244/21 |

*Primary Examiner*—Trygve M. Blix
*Assistant Examiner*—Galen Barefoot
*Attorney, Agent, or Firm*—Robert Charles Hill

[57] ABSTRACT

A free flying aerodynamic toy that is manually launched and is composed of an elongate air foil having two identical surfaces that are joined to one another symmetrically of the longitudinal axis so that in response to rotation and translation through air, the surfaces sequentially cooperate with air flow thereover to produce lift. Circular stabilizer plates at opposite ends of the air foil produce vertical stability and have weighted peripheries to increase rotational inertia. Centrally of the air foil is a rib which divides the air foil into two symmetrical parts. The parts extend outward from the rib at a positive dihedral angle (an included angle less than 180°) so as to enhance stability and reduce roll and yaw of the toy.

4 Claims, 5 Drawing Figures

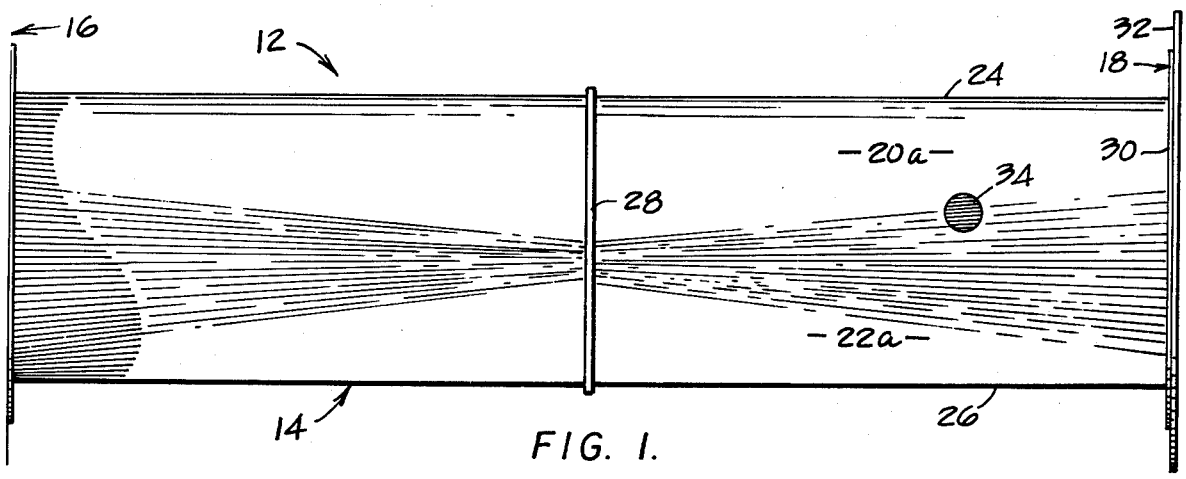
FIG. 1.
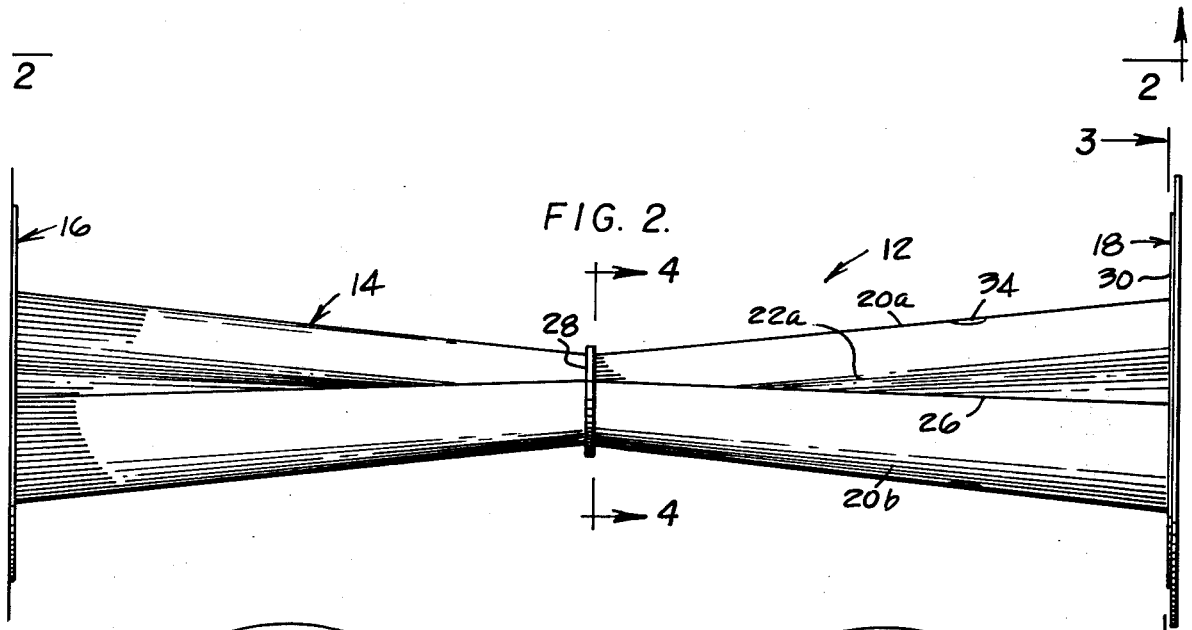
FIG. 2.
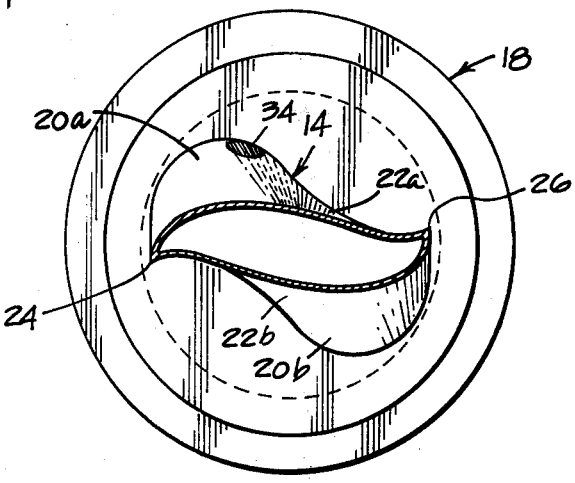
FIG. 4.
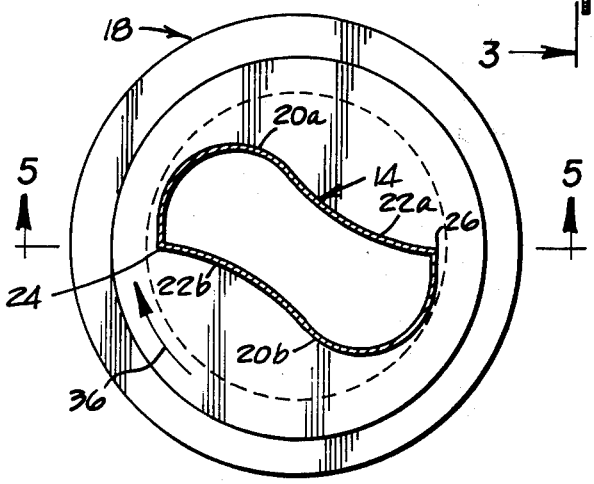
FIG. 3.
FIG. 5.
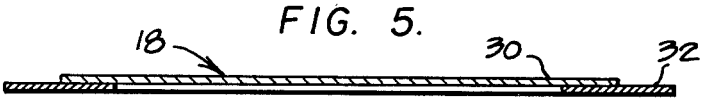

FREE FLYING AERODYNAMIC TOY WITH HIGH STABILITY

BACKGROUND OF THE INVENTION

1. Field of the Invention

This invention relates to an aerodynamic toy and more particularly to such toy that is capable of free flight so that it can perform maneuvers upon being thrown into the air by the user thereof.

2. Description of the Prior Art

U.S. Pat. No. 2,501,442 (244-153) discloses an air foil kite which contains a rotating air foil that rotates with respect to a central shaft which is supported at the ends of threads or strings, the opposite ends of the strings being controlled from the ground by the user of the device. U.S. Pat. No. 3,262,656 (244-10) discloses a wing rotor which employs variable control surfaces and has an autorotating wing having a negative dihedral angle.

U.S. Pat. No. 3,439,887 (244-10) discloses a rotary wing having moveable parts for effecting control of the same during flight.

SUMMARY OF THE INVENTION

According to the invention there is an air foil capable of producing lift in response to rotation about the longitudinal axis thereof. At opposite longitudinal ends of the air foil are end plates which reinforce the air foil and act as vertical stabilizers. The end plates are of composite construction with concentrated weight at their outer peripheries to increase rotative inertia. The air foil, in a preferred form of the invention, is formed by two symmetrical portions which taper toward the longitudinal center to form a positive dihedral angle. Such preferred form has improved stability, particularly in turbulent air.

An object of the present invention is to provide a rotary wing toy that is constructed so as to be self-stabilizing on the roll axis and the yaw axis. This object is achieved by the present invention by providing a wing having a centrally disposed rib with respect to which opposite surfaces form a positive dihedral angle so that when the wing varies from a horizontal attitude the air foil surface experience lift differential so as to restore the device to horizontal.

Also contributing to the stability of the free flying rotary wing of the invention are vertically oriented flat end discs. The end discs are substantially flat or discontinuity free and have peripheries of relatively greater weight so as to interact with air currents to stabilize the device as well as possessing rotational inertia to promote smooth rotation of the wing.

Another object of the invention is to provide substantial lift even in circumstances where the relative speed between the air foil surface and the air is slight. This object is achieved according to the present invention by providing a pair of air foils having a large camber behind which is a concave portion. The high camber region upon the wing enhances lift even at slow relative speeds and the concave portion contributes to this by reducing the stall speed of the air foil.

By providing a wing capable of achieving the aforestated objects, the invention can be embodied in a light weight structure having a length of approximately 8 inches and a weight of approximately 9 grams. Such device can perform well indoors, where air turbulence is slight or outdoors where there are significant gusts or turbulence.

The foregoing together with other objects, features and advantages will be more apparent after referring to the following specification and the accompanying drawings.

BRIEF DESCRIPTION OF THE DRAWING

FIG. 1 is a side view of an aerodynamic toy embodying the invention.

FIG. 2 is a view taken along the plane designated by line 2—2 of FIG. 1.

FIG. 3 is a cross sectional view taken on a plane designated by line 3—3 of FIG. 2.

FIG. 4 is a cross sectional view taken on a plane designated by line 4—4 of FIG. 2.

FIG. 5 is a cross sectional view at enlarged scale taken along a plane designated by line 5—5 of FIG. 3.

DESCRIPTION OF THE PREFERRED EMBODIMENT

Referring more particularly to the drawing, reference numeral 12 indicates an aerodynamic toy embodying the present invention. The toy includes an air foil 14 at opposite ends of which are identical composite end plates 16 and 18 which stabilize the air foil during flight and which reinforce the parts of the air foil.

As seen most clearly in FIGS. 3 and 4 air foil 14 is composed of two substantially identical aerodynamic surfaces that are symmetrical with respect to the longitudinal axis of the air foil. The upper surface, as viewed in FIG. 3, includes a convex portion **20*a* and a concave portion 22*a* which extends from the convex portion in a smooth discontinuity free configuration. The lower aerodynamic surface as viewed in FIG. 3 includes a convex portion 20*b* and a concave portion 22*b* which are substantially identically configured to the configuration of portions 20*a* and 22*a* of the upper surface. Portions 20*a* and 22*b* are joined at their extremities to form a joint 24, and portions 22*a* and 20*b* are joined at their extremities to form a joint 26 that is oppositely and symmetrically disposed with respect to joint 24. The straight line distance between edges 24 and 26** is characterized as the chord of the air foil.

Centrally of air foil 14 is a reinforcing rib 28 with respect to which respective lateral portions of the air foil are symmetrical. As can be seen most clearly in FIG. 2 the lateral portions of the air foil taper inward or converge toward rib 28 so as to form between the respective lateral portions of the air foil a positive dihedral angle, i.e., an angle less than 180°. As seen most clearly in FIG. 4, the surfaces of air foil 14 diverge smoothly from rib 28 at the mid point of the air foil to the respective lateral extremities thereof.

Cooperating with rib 28 to maintain the air foil in the shape described hereinabove and shown in the drawing are end plates 16 and 18. The end plates are of composite construction and include a solid central disc 30 and an annular portion 32 which is secured to the peripheral margin of disc 30 and concentric therewith. In one structure designed according to the present invention, disc 30 is constructed of heavy paper whereas annular portion 32 is constructed of relatively more dense synthetic resinous material, commonly referred to as plastic. The thicknesses of disc 30 and annular portion 32 are exaggerated in FIG. 5 for clarity of disclosure. In fact, the outer surface of each end plate (the lower surface as viewed in FIG. 5) is substantially smooth in view of the fact that the annular portion 32 has a thickness no greater than about 0.010 inches and is adhesively joined to the disc at an overlapping marginal region of the central disc and the annular portion. Accordingly, the respective end plates 16 and 18 afford substantial vertical stability to the toy without creating any significant degree of turbulence. The junction between the air foil and the respective discs 30 is formed by any suitable adhesive, glue or cement whereby a rugged, light weight structure is formed.

Because of the symmetry of the toy with respect to central rib 28, one side of the air foil, the right hand side as viewed in the drawings, is provided with a visual indicium 34 which, as will appear, assists the user in launching the toy. Indicium 34 has no structural or aerodynamic properties, and the same function can be achieved by any suitable visual indicium on the air foil or on one of the end plates 16, 18.

The manner of launching the toy of this invention can be appreciated by reference to FIG. 1. The user orients the toy so that visual indicium is to the right hand side of rib 28. The four fingers of the right hand are engaged on edge 24 symmetrically of rib 28, i.e., two fingers are disposed on either side of the rib. The thumb is engaged with edge 26 on or adjacent rib 28. The user, in an overhand motion, then throws the device in a generally horizontal direction, simultaneously imparting a spinning or rotative motion to the air foil in the direction indicated by the arrow 36 in FIG. 3. Stated otherwise, such direction of rotation is such that, as viewed in FIG. 1, edge 24 moves toward the viewer and edge 26 moves away from the viewer. The toy is thus launched with combined translational movement and rotative movement through the air. As a result of such translational and rotative movement through the air, there is relative movement between the air and the surfaces of air foil 14 which imparts lift to the toy so that the toy will glide for a long distance, and if thrown with sufficient vigor, can be made to climb and even loop.

The foregoing maneuvers are made possible in part by the composite construction of the end plates which, because of the relatively larger weight of peripheral portion 32, has rotative inertia which assists in maintaining the rotational movement imparted by the user of the device. Moreover, the positive dihedral angle of the two laterally spaced air foil portions stabilizes the traveling air foil with respect to the roll axis. That is to say, if the longitudinal axis of the toy assumes a non horizontal position, there is an increase in the relative angle of attack between the lower end of the air foil and the relatively moving air. This restores the longitudinal axis of the toy to a horizontal position. Moreover, because of the dihedral angle, the mass of the outer ends of the air foil is greater than the center which, in conjunction with the composite construction of end plates 16 and 18 affords substantial stabilizing forces on the toy during flight. The composite construction of the end plates, in that they enhance continuation of rotation of the end plates, also improve stability by exploiting the gyroscopic effect which arises as the discs rotate.

The toy of the invention can also be launched in an underhanded manner so long as the direction of rotation referred to above is achieved. The hand grip on the toy is the same as is described above; however, the launching of the device is achieved by an underhanded swinging motion so that when the toy is launched along a translational path the direction of rotation will be as indicated by arrow 36, i.e. on convex surface portion **20*a* leads the concave portion 22*b* on the side of joint 24 opposite from convex portion 20*a*.** When launched in an underhanded manner, the toy will perform a downward loop and return to the launcher.

Contributing to the excellent aerodynamic properties and stability of the present invention is the substantial thickness of the air foil, that is, the camber or overall dimension of the air foil in a direction perpendicular to the chord, the chord being the straight line distance between edges 24 and 26. As shown in FIG. 3, the maximum camber is at least about three-eighths the length of the chord and this dimension occurs approximately one-fourth of the chordal length rearward (rightward as viewed in FIG. 3) of edge 24. The consequence of this substantial camber, in a ratio of at least about 3 to 8 to the chord length, is that smooth air flow over the upper surface, i.e. over surface **20*a* is sustained for higher angles of the attack with respect to the direction of translation. Although as the air foil rotates, each surface eventually stalls, i.e. the air flowing thereover eventually goes from laminar flow to turbulent flow, the stall appears at a substantially high angle so that the loss of lift is minimized. It will be noted in FIG. 4** that the camber of the air foil decreases toward the longitudinal mid point of the air foil whereas the chord length remains approximately the same.

One toy designed according to the present invention is formed of relatively stiff paper, the exterior of which is coated with plastic paint so as to make it smooth, strong and totally air impervious. The air foil has a length of approximately 8 inches. The chord length of such exemplary device is approximately 2 inches and the diameter of end plates 16 and 18 is about 3 inches. Such exemplary toy has a weight of approximately 9 grams. Accordingly, there is substantial active surface of the end plates which affords stability, reduces if not eliminates side slip, and, because of the presence of relatively dense annular portion 32, provides substantial rotational inertia which facilitates smooth and continued rotation of the device.

Thus it will be seen that the present invention provides an aerodynamic toy of simple construction, low cost, and substantial stability both in smooth air and in mildly turbulent air. Because of the carefully balanced aerodynamic properties present in the toy, it can be flown either straight by beginners or can be made to perform numerous more complicated maneuvers by those having more experience in its use. Although one embodiment of the invention has been shown and described, it will be obvious that other adaptations and modifications can be made without departing from the true spirit and scope of the invention.

What is claimed is:

1. An aerodynamic toy comprising in a unitary assembly an elongate air foil having two substantially identical surfaces, each surface having a convex portion and a concave portion extending from the convex portion in a smooth discontinuity-free configuration, the convex portion of each said surface terminating in an edge coterminous with the extremity of the concave portion of the other said surface so that there are two edges diametrically spaced which define a chord therebetween, right and left hand circular stabilizing end plates mounted coaxially to respective ends of said elongate air foil, a rib midway between said end plates rigid with said air foil, said surfaces converging inwardly from respective said end plates to said rib so as to form an angle less than 180° between said surfaces on opposite sides of said rib, said chord is substantially constant throughout the length of said elongated air foil, said plates having equal diameters greater than said chord and defining substantially planar surfaces to avoid turbulence thereover so that said toy flies when thrown so as to spin in a direction wherein the convex portion of one surface rotationally leads the concave portion of the other surface.

2. An aerodynamic toy according to claim 1 wherein the maximum camber between said chord and the outermost extremity of said convex portion is at least about three-eighths of the length of the chord.

3. An aerodynamic toy according to claim 2 wherein said maximum camber is disposed along the chord approximately one quarter the length of the chord from the edge at which the convex portion terminates.

4. An aerodynamic toy according to claim 1 wherein said end plates have a diameter at least about 3/2 times the length of the chord, said end plates being of composite construction having a planar central disc secured to said air foil and a planar annular portion secured to the periphery of said disc, said annular portion having a greater density than said circular portion so as to enhance the rotational inertia of said toy.

* * * * *